US008006624B2

(12) United States Patent
Sin

(10) Patent No.: US 8,006,624 B2
(45) Date of Patent: Aug. 30, 2011

(54) MACHINE FOR UNLOADING AND POSITIONING RAILS ON CROSSTIES IN RAILWAY TRACKS

(75) Inventor: Rafael Valero Sin, Madrid (ES)

(73) Assignee: Tecsa Empresa Constructora, S.A., Madrid (ES)

( * ) Notice: Subject to any disclaimer, the term of this patent is extended or adjusted under 35 U.S.C. 154(b) by 162 days.

(21) Appl. No.: 12/481,070

(22) Filed: Jun. 9, 2009

(65) Prior Publication Data

US 2009/0301340 A1 Dec. 10, 2009

(30) Foreign Application Priority Data

Jun. 10, 2008 (ES) ..... 200801748

(51) Int. Cl.
*E01B 29/00* (2006.01)

(52) U.S. Cl. ..... 104/2; 104/7.1; 212/324; 212/327; 414/337; 414/460

(58) Field of Classification Search ..... 104/2, 3, 104/5, 7.1, 16, 17.1, 17.2; 212/312, 319, 212/324, 326, 327; 414/337, 339, 460, 800, 414/809

See application file for complete search history.

(56) References Cited

U.S. PATENT DOCUMENTS

| | | | | |
|---|---|---|---|---|
| 3,041,982 | A * | 7/1962 | Plasser et al. | 104/7.1 |
| 3,299,833 | A | 1/1967 | Stewart | |
| 3,491,467 | A | 1/1970 | Finger | |
| 4,516,503 | A | 5/1985 | Boccaletti | |
| 5,586,502 | A * | 12/1996 | Weber | 104/17.2 |
| 6,581,526 | B2 * | 6/2003 | Theurer et al. | 104/279 |
| 6,954,974 | B2 | 10/2005 | Rada | |
| 2007/0199472 | A1 * | 8/2007 | Theurer et al. | 104/7.1 |

FOREIGN PATENT DOCUMENTS

| | | | |
|---|---|---|---|
| EP | 0084298 | A1 | 7/1983 |
| EP | 0285847 | A1 | 10/1988 |
| ES | 2299552 | T3 | 1/2008 |
| FR | 753732 | A | 10/1933 |
| FR | 1455800 | A | 5/1966 |
| GB | 2160919 | A | 2/1966 |

OTHER PUBLICATIONS

Search Report issued by Spanish patent office on Jun. 10, 2008 for corresponding Spanish parent application.

* cited by examiner

*Primary Examiner* — Mark T Le
(74) *Attorney, Agent, or Firm* — Brown & Michaels, PC

(57) ABSTRACT

A machine for uploading and positioning rails on crossties in railway tracks includes an inverted U-shaped gantry (1-2), with side branches finished at the lower part in respective caterpillar tracks (4) of movement on the ballast of the beam on both sides of the platform of crossties. The gantry (1) supports a pair of clamps (8) with jaws (16), for fixing the rails by the core thereof, and preventing pitching, which clamps (8) close by means of respective hydraulic cylinders (10) movable in height actuated by another hydraulic cylinder (15) through a deformable parallelogram (12), while at the same time they are longitudinally movable by the actual movement of the machine. The machine thus moves forward towards the rail carrier train located at the end of the track under construction, grasps a pair of rails with its clamps, and pulls them without contact with the ground until they are arranged on their assembly position, the rails serving for the forward movement of the rail carrier train.

6 Claims, 3 Drawing Sheets

MACHINE FOR UNLOADING AND POSITIONING RAILS ON CROSSTIES IN RAILWAY TRACKS

OBJECT OF THE INVENTION

The present invention relates to a machine which has been especially designed to facilitate both unloading and positioning rails of railway tracks on the complementary crossties, from a rail carrier train or another suitable transport vehicle. The machine allows unloading and arranging each rail on the crossties of the track virtually in the definitive position that said rails must finally adopt.

The object of the invention is to allow unloading and positioning the rail directly on the bearing plates of the crossties, preventing subsequent handling for transversely replacing them. This operation is performed by pulling on an end of the rail by means of the machine, performing a longitudinal pull until it is completely laid. The invention is thus applicable to the field of the railway industry.

BACKGROUND OF THE INVENTION

In the jobs for assembling railway tracks, one of the main activities consists of unloading and distributing the rail along the track section which is to be assembled. This is usually carried out by using a rail carrier train which, as it moves forward, gradually unloads the rail previously secured at one end to a fixed anchoring point.

The unloading is carried out by positioning the rail in the longitudinal pull thereof on both sides of the crossties, which involves a high risk of serious deterioration for the rail itself.

This problem is considerably worsened when dealing with newly constructed tracks, where there is no track over which the rail carrier train can travel, so a provisional auxiliary track is assembled. This allows distributing the rail on the track to be assembled from the rail carrier train traveling over the auxiliary track. This process entails a high additional cost involved in the manufacture, assembly and successive transport operations of this auxiliary track, in addition to the problems of transporting or finally positioning each rail in its definitive location site.

DESCRIPTION OF THE INVENTION

The machine proposed by the invention fully and satisfactorily solves the previously mentioned problem, enabling the unloading of the rail by means of the pull thereof, since the machine moves by suitable means and prior placement of the crossties, on both sides thereof.

More specifically, the machine moves unloading and positioning the rail on the bearing plates of the crossties without needing to assemble an auxiliary track.

The machine allows pulling on the rail and moving it longitudinally to unload and position it, with the collaboration of a rail carrier train or another suitable transport vehicle, which remains at rest located at the final end of the last assembled track section, exactly at the initial point of a section which is to be assembled, without needing to have a track over which said train can travel and allowing carrying out this process without causing any deterioration in the rail, the ballast bed or in the rest of the materials forming the track (track structure), since the rails are held by means of clamp arms holding the rail by its core, preventing its side tipping and preventing its deterioration due to the pull.

More specifically, the proposed machine is formed from a gantry, movable on caterpillar tracks which it incorporates at the ends of its side branches, conferring to said gantry the proper stability and allowing its movement by means of a motor on the ballast bed. Said gantry has incorporated therein two arms with respective clamps at their ends for securing the rail, which clamps can be regulated both longitudinally and in terms of their mutual separation, in order to adapt to different track gauges, with the special particularity that said clamps, vertically movable in the operations for lowering the rails, maintain their horizontalness by means of a movement transmission system based on a deformable parallelogram, in order to prevent the existence of friction of the rails in the longitudinal movement thereof.

It must only be finally indicated that the caterpillar tracks are covered by means of protective plates to prevent the thrust of any stone which may collide against the personnel working next to the machine.

DESCRIPTION OF THE DRAWINGS

To complement the description which is being made and for the purpose of aiding to better understand the features of the invention according to a preferred practical embodiment thereof, a set of drawings is attached as an integral part of said description, in which the following has been depicted with an illustrative and non-limiting character.

PREFERRED EMBODIMENT OF THE INVENTION

Figure 1:
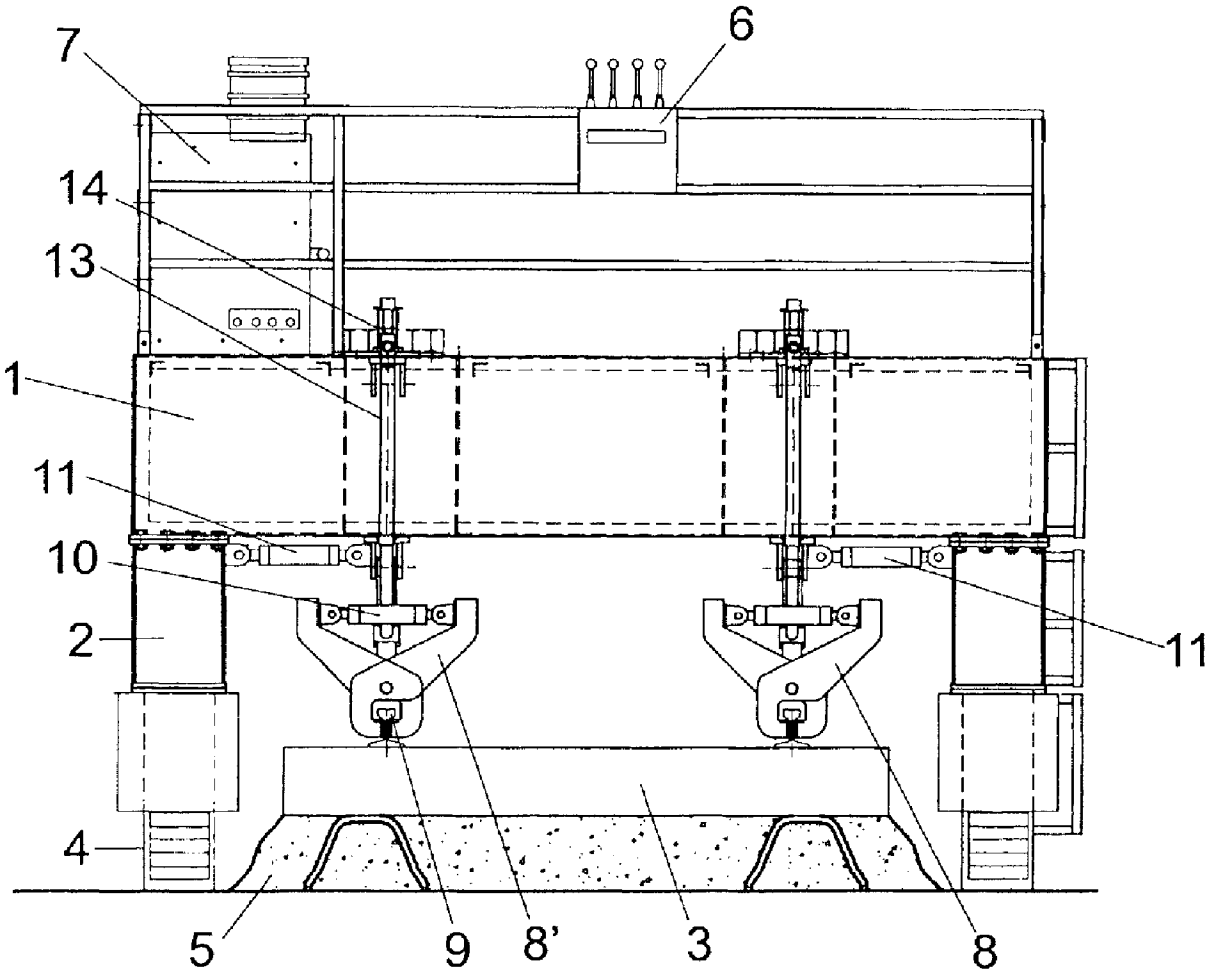
FIG. 1 shows a schematic front elevational depiction of a machine for unloading and positioning rails on crossties in railway tracks, made according to the object of the present invention.
Figure 2:
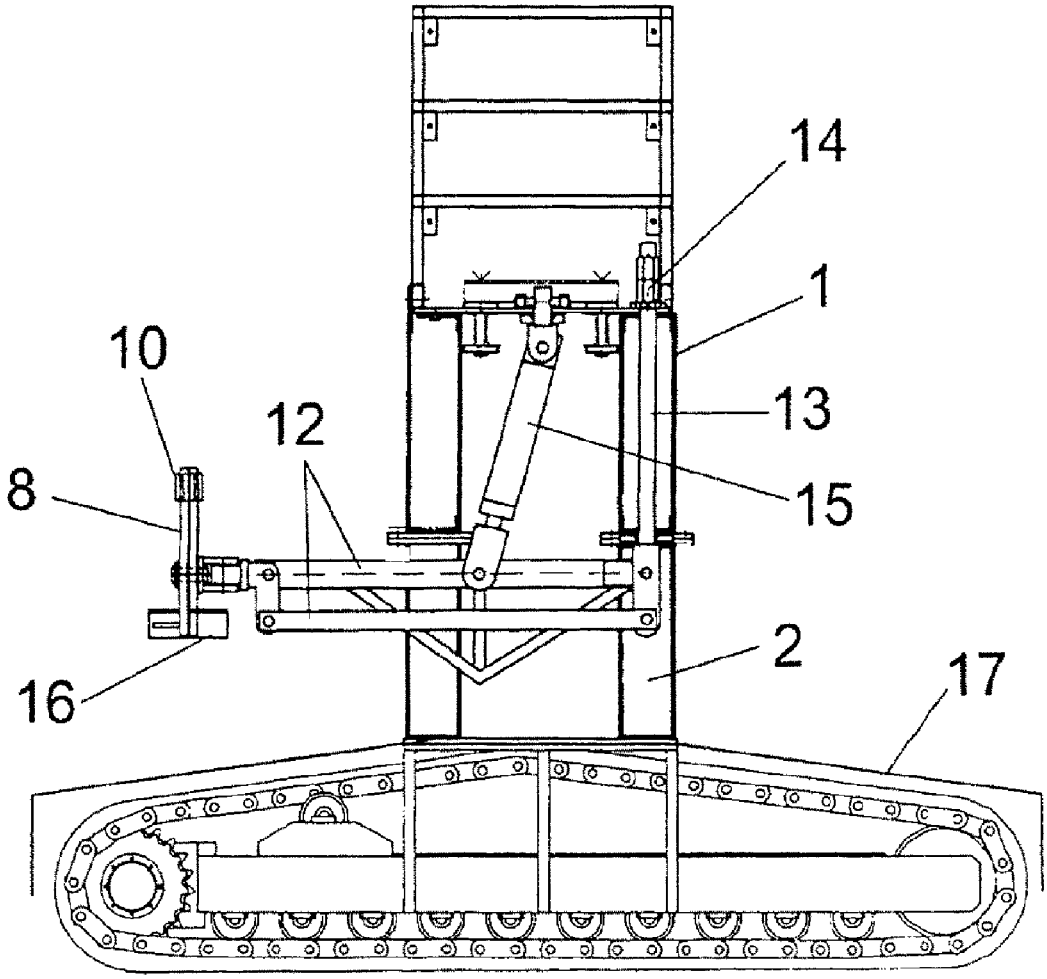
FIG. 2 shows a profile of said machine in a maximum elevational situation for the clamps for holding the rails.
Figure 3:
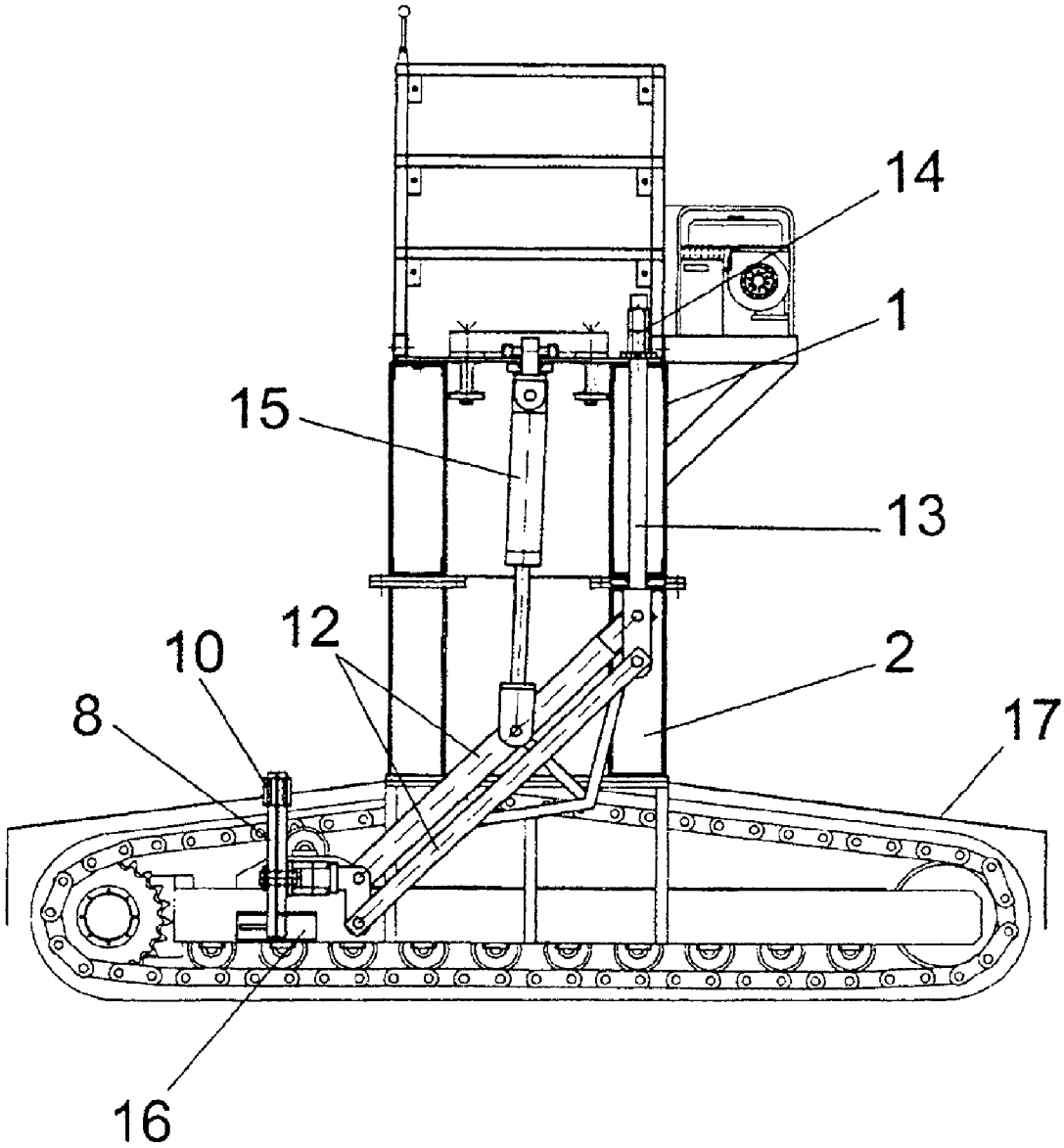
FIG. 3 finally shows a depiction similar to that of FIG. 2, but in which the clamps adopt a lower limit position.

In view of the indicated figures, it can be observed how the proposed machine is formed from a gantry (1), with a suitable width for its side branches (2) to be located outside the crossties (3) of the track, respectively on both sides thereof, as observed especially in FIG. 1, said side branches (2) of the gantry (1) being finished in respective caterpillar tracks (4), which are in turn especially visible in FIGS. 2 and 3, which move on the ballast (5) of the track on both sides of the crossties (3), said caterpillar tracks (4) logically being duly motor-driven and controlled from a control center (6) aiding a hydraulic station (7).

The mentioned gantry (1) forms the support for a pair of clamps (8-8') intended to unload and position respective rails (9), which clamps close on the core of the rails (9), as observed in FIG. 1, by means of double-acting hydraulic cylinders (10) acting on the arms of the clamps.

Said clamps (8-8') have an separation which can be regulated, for the purpose of being adjusted to different track gauges, for which purpose each clamp is in turn aided by another double-acting hydraulic cylinder (11) determining a greater or lesser approach with respect to the corresponding side branch (2) of the gantry.

As observed in FIGS. 2 and 3, each clamp (8-8') is associated to a deformable parallelogram (12) with a height position which can in turn be regulated through a support (13), threaded at the upper part and aided by a nut-counternut locking system (14), said parallelogram (12) being a swinging parallelogram due to the action of an elevation hydraulic cylinder (15) assembled between the horizontal branch of the gantry (1) and the deformable parallelogram (12) itself, such that the clamps (8) can adopt any intermediate position between the end positions shown in FIGS. 2 and 3, maintaining at all times the horizontalness for the actual jaw (16), which is considerably elongated, as is also observed in these two figures, so that in the securing of the rails (9) the latter are perfectly stabilized and are prevented from side tipping or pitching movements.

According to this structure, the operation of the machine is as follows:

A rail carrier train or any other suitable transport vehicle moves closer to the work area through the already constructed track, which train or vehicle stops exactly where the last assembled rails (9) end. In this situation for the rail carrier train, the machine of the invention approaches it with its jaws (8) raised and open, and once the suitable approach situation is reached, said jaws (8) move downwards until abutting against the rails (9), through the cylinders (15), and finally they close on said rails through the cylinders (10). Once the rails are secured, the cylinders (15) raise them to make them independent of the rail carrier train, the machine moves in a forward movement direction, i.e., in a direction of separation with respect to the rail carrier train, and finally deposits the rails (9) on the platform defined by the crosstie (3), in a situation of alignment and continuity with the previously fixed rails (9), being able to immediately afterwards fix the new rails to the crossties, move the rail carrier train forward thereon and, then repeat the described operative cycle.

Given that in these movements of the machine on the ballast (5) it is usual for the caterpillar tracks (4) to raise stones and throw them sideways with force, it has been provided that said caterpillar tracks are duly covered by a protective plate (17) preventing said stones from impacting the operators working close to the machine.

The invention claimed is:

1. A machine for unloading and positioning a plurality of rails on a plurality of crossties in railway tracks, comprising:

a gantry including a main body (1);

two side branches (2) extending downwardly from the main body and supported on a pair of side caterpillar tracks (4);

a pair of adjustable clamps (8,8'), each said clamp comprising a pair of clamp arms configured to hold a rail;

two first hydraulic cylinders (10), each said cylinder interconnecting the pair of clamp arms of one of the adjustable clamps to close onto a web of the rail;

two vertical support rods (13), each said rod extending vertically through the main body (1), and having a lower end supporting one of the adjustable clamps and an upper end including a screw threaded portion, a nut, and a counter locking nut together forming a mechanism for adjusting the one of the adjustable clamps vertically; and two second hydraulic cylinders (11), each said second hydraulic cylinder having one end attached to one of said vertical support rods, and another end attached to one of the two side branches to laterally adjust the one of the vertical support rods and one of the adjustable clamps.

2. The machine of claim 1, wherein each said adjustable clamp is connected to one of said vertical support rods through a deformable parallelogram (12) that is actuated by an elevation hydraulic cylinder (15) so as to maintain the adjustable clamp in a horizontal arrangement regardless of a height level.

3. The machine of claim 1, wherein the side branches are located outside of the crossties, the caterpillar tracks are configured to move on a track ballast, and protective plates (17) are provided to cover said caterpillar tracks.

4. The machine of claim 1, wherein the second hydraulic cylinders are configured to adjust the adjustable clamps to different track gauges.

5. The machine of claim 1, wherein the adjustable clamps are configured for unloading rails from a rail transport vehicle and depositing the rails on a railway track in correctly aligned positions.

6. The machine of claim 5, wherein the rail transport vehicle is a rail carrier train.

* * * * *